United States Patent [19]

Ferris

[11] 4,102,287

[45] Jul. 25, 1978

[54] CATAMARAN WITH SWINGABLE MAST AND HULLS

[76] Inventor: Hamilton Y. Ferris, 880 W. Cliff Dr., #6, Santa Cruz, Calif. 95061

[21] Appl. No.: 784,667

[22] Filed: Apr. 5, 1977

[51] Int. Cl.[2] ..... B63H 9/04

[52] U.S. Cl. ..... 114/39; 114/61; 114/91

[58] Field of Search ..... 114/39, 61, 90, 91, 114/123, 125, 102

[56] References Cited

U.S. PATENT DOCUMENTS

| | | | |
|---|---|---|---|
| 457,323 | 8/1891 | Matthews | 114/91 |
| 3,137,263 | 6/1964 | Sainte-Claire | 114/125 |
| 3,142,282 | 7/1964 | Nichols | 114/39 X |
| 3,179,078 | 4/1965 | Popkin | 114/39 X |
| 3,656,445 | 4/1972 | Padwick | 114/39 |
| 3,839,979 | 10/1974 | Wassell | 114/61 |
| 3,841,251 | 10/1974 | Larson | 114/61 X |
| 3,996,874 | 12/1976 | Winch | 114/39 X |

*Primary Examiner*—Trygve M. Blix
*Assistant Examiner*—Sherman D. Basinger
*Attorney, Agent, or Firm*—Robert G. Slick

[57] ABSTRACT

A multiple hull craft such as a catamaran is provided having outrigger hulls which can be swung to either of two positions 180° apart and locked in either position. The mast is swingable about a center structure through an angle of 180° and is secured at either extreme. These features allow one to sail a boat after it has capsized as is hereinafter described in detail.

5 Claims, 5 Drawing Figures

CATAMARAN WITH SWINGABLE MAST AND HULLS

SUMMARY OF THE PRIOR ART

The closest known prior art is U.S. Pat. No. 3,656,445 which decribes a multi-hull boat having a mast which can be swung to 180° and locked in either position. The present invention differs primarily from said prior patent in that the patent shows a boat with hulls having horizontal and vertical symmetry while the present invention shows an improved form of boat wherein conventional hulls are employed which can be swung through 180°.

SUMMARY OF THE INVENTION

Catamarans are popular boats primarily because of their great speed and light weight but they suffer from the deficiency that once capsized the boat is almost impossible to right, particularly when sailed by a single person.

It has previously been proposed to provide a catamaran with a sail on a mast wherein the mast can be swung to 180° and locked in either of the positions. This provides some degree of safety but does not provide a fully satisfactory boat since the hulls extend equally above and below the spars and thus the spars connecting the hulls including the deck area must of necessity be undesirably close to the water.

In accordance with the present invention, a catamaran is provided with hulls which normally extend entirely or almost in their entirety below the spars so that the spars are always maintained at a substantial distance above the water surface. The hulls are provided with pivots and locking members so that they can extend at right angles either above or below the spar. This means that if the boat capsizes, the hulls, which would then be sticking up in the air, can be unlocked, and swung 180° so that they are now again beneath the spars; this is easily done by a single person. The mast is similarly swung to 180° so that the catamaran has substantially the same water clearance and sailability regardless of which side of the spars the mast and hulls are on.

Other features and advantages of the present invention will be brought out in the balance of the specification.

DESCRIPTION OF THE PREFERRED EMBODIMENTS

Figure 1:
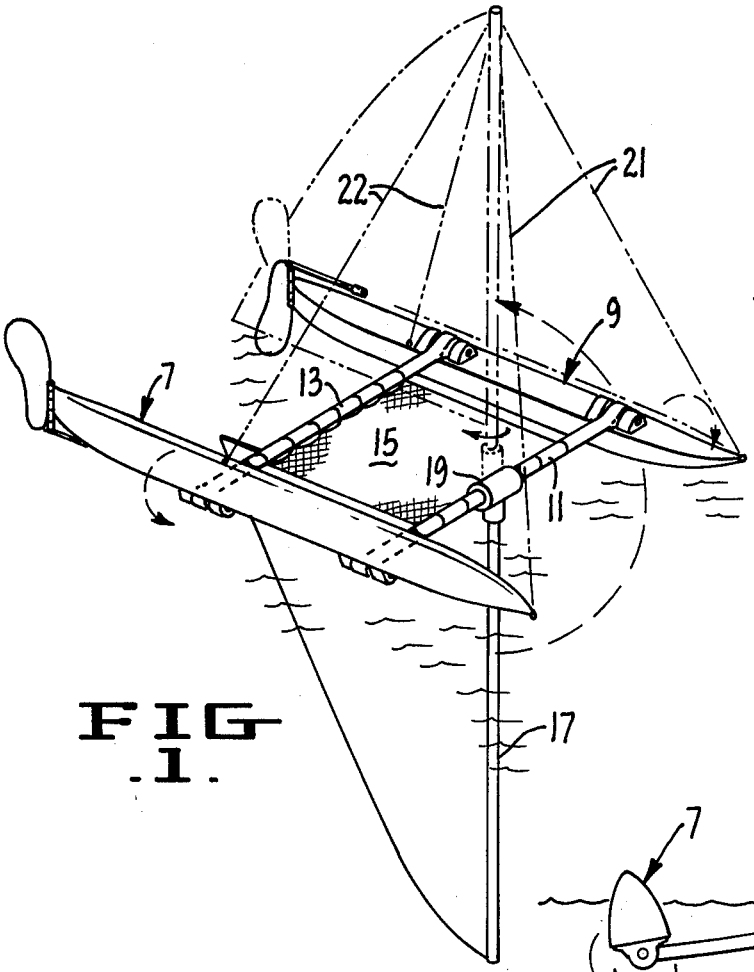
FIG. 1 is a perspective view of a catamaran embodying the present invention.

Referring now to the drawings by reference characters, a boat is shown having hulls 7 and 9 which are supported in spaced relationship by means of a forward spar 11 and an aft spar 13. The spars also support a net 15 or other suitable decking. The forward spar supports a mast 17 which is mounted for rotation on a bearing 19 and which is held in position by bow and stern stays 21 and 22 respectively or other suitable means.

Figure 2:
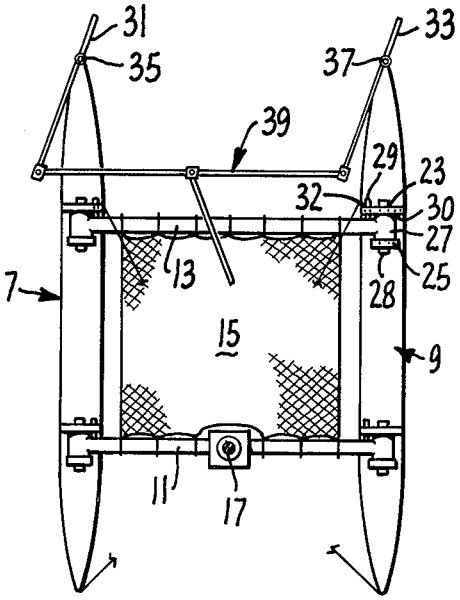
FIG. 2 is a plan view of the catamaran shown in FIG. 1.

Hulls 7 and 9 are provided with bearings for attachment to the spars 13 and 19. Since all four connections are substantially the same, only one is described in detail. Thus, referring particularly to FIG. 2, bearings 23 and 25 are provided on the upper surface of the hull and the end of the spar 13 is enlarged and supports a mating bearing 27. Shaft 28 passes through bearings 23, 27 and 25 so that hull 9 can rotate with respect to spar 13. A removable pin 29 extends through bearing 23 and into a selected one of two mating holes in spar 13. These holes 30 and 32 are 180° apart in the end of bearing 23. Thus, the pin 29 will hold the hull in either of two selected positions 180° apart.

In a practical embodiment of the invention, the craft would ordinarily have a pair of rudders 31 and 33 which swing on the removable pins 35 and 37. The rudders would incorporate the usual steering apparatus generally designated 39.

Figure 3:
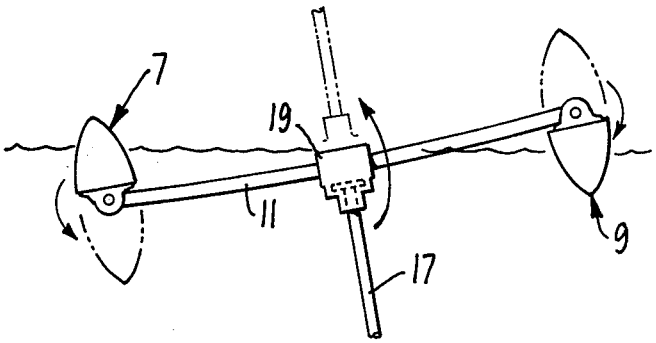
FIG. 3 is a diagrammatic view showing the method of swinging the hulls and the mast.

Normally of course, the mast would extend above the spars 11 and 13 and the two hulls would extend below spars 11 and 13, the mast and hulls being held in their respective positions by means of the stays and pins described. If the boat capsizes, it is easily restored to sailing condition even if it is only sailed by one person. Thus, referring particularly to FIGS. 1 and 3, the boat is shown with the mast 17 in solid lines under the water and the hull 7 extending above the water, in a position which these parts would assume when the boat capsizes. Obviously the hull 9 would also normally be above the spars 11 and 13. However, the right-hand hull 9 in FIGS. 1 and 3 has been shown as it would be in the first stage of righting the craft. In other words, the pin 29 has been withdrawn and the hull 9 swung through 180° and locked by replacing the pin 29 in hole 30. Obviously it is necessary to first free the connecting rod 32 from the tillers before the hulls can be inverted. Now one repeats the operation with hull 7, swinging it from the position shown in solid lines in FIG. 3 to the position shown in dot-dash lines. The hull is locked in place with a pin as previously described. Now one disconnects the stern stays so that the mast is free to swing forward and upward through 180° bringing it from the position shown in solid lines in FIGS. 1 and 3 to the position shown in dot-dash lines and then locks the mast in the new position shown in dot-dash lines and then secures the mast in the new position by reattaching the stern stays. The connecting rod 32 can now be reconnected to the tillers as a final preparatory step to realizing a self-rescuing capability in this inverted position.

Figure 4:
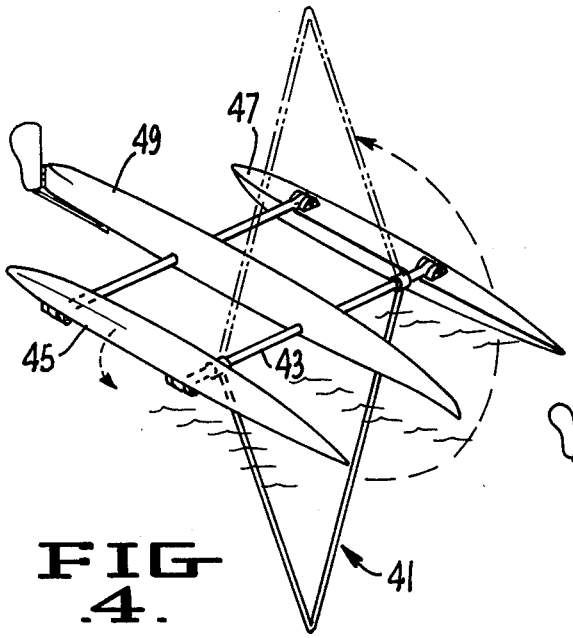
FIG. 4 shows an alternative embodiment of the invention using an A-frame mast which is a necessity in applying this self-rescuing principle to a trimaran as the A-frame mast can swing around the center hull. It should be noted that the A-frame mast can also be mounted on a catamaran to give thwartship rigidity not possible with an unstayed conventional mast.
Figure 5:
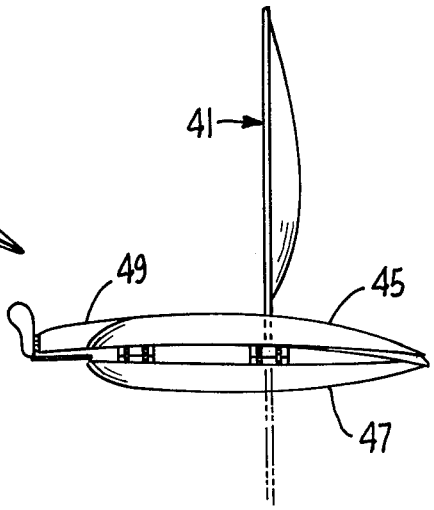
FIG. 5 is a side view of the boat shown in FIG. 4 showing the position of the parts after the boat has been righted.

As is shown in FIGS. 4 and 5, the invention is applicable to a boat having an A-frame mast and illustrated as applied to a trimaran although the A-frame mast might be used on a craft having two hulls. Here, the A-frame mast generally designated 41 is journaled on the spar 43 near the outer extremities of the spar with bow and stern stays (not shown) for securing the A-frame mast in either of the positions shown in solid lines or in dot-dash lines. The hulls 45 and 47 are fastened to the spars with connections which can be swung and locked 180° apart as previously described. In the case of a trimaran, the center hull 49 is fastened to the spars. If the boat capsizes the hulls 45 and 47 can be inverted as previously described and the A-frame mast can be similarly swung to 180° and secured. The center hull 49 will remain inverted but clear of the water due to the buoyancy of hulls 45 and 47 which are now in a normal sailing position, below the spars and inverted center hull, making it possible to sail the trimaran unaided to a safe port.

Although certain specific embodiments of the invention have been shown, it is obvious to those skilled in the art that many departures can be made from the exact structure shown without departing from the spirit of this invention. For instance, locking pins have been shown for locking the hulls and the mast at desired positions and other fastening means can be employed.

I claim:

1. In a boat:

a. a center supporting structure disposed on a horizontal plane and including a forward spar, b. a pair of hulls at each side edge of said center supporting structure and connected together by said forward spar, c. hull locking means attaching said hulls to said forward spar, said locking means having bearing means rotatably mounting said hulls on said forward spar so that said hulls are mounted for rotation at the side edges of said central structure, d. said hulls normally extending downward from said center structure into water and supporting said central structure above the water surface, e. locking means on said bearing means normally maintaining said hulls extending downwardly from said center structure, f. said locking means being adapted to release said hulls and permit said hulls to be rotated 180° and relocked whereby said center structure can be turned over to an inverted position and said hulls repositioned to extend downward from said inverted position of the center structure, and g. a mast supporting bearing rotatably mounted on said forward spar of the boat, said mast supporting bearing journally receiving said forward spar therethrough so that said mast supporting bearing is rotatably about said forward spar through an angle of at least about 180° so that a mast supported on said forward spar is movable from a first position extending vertically downwardly from said forward spar to a second position about 180° from said first position with said mast vertically upwardly from said forward spar so that a capsized boat can be righted by one person.

2. The structure of claim 1 including a mast which can be rotated from a first position on one side of said center structure to a second position on the other side and means of locking said mast in said first or second positions.

3. The structure of claim 2 wherein the mast is an A-frame mast.

4. The boat of claim 1 wherein the center structure includes a pair of spars having bearings on each end of the spars and wherein the hulls have mating bearings located on one side of the hulls whereby the hulls can be rotated relative to the spars and locking means where the hulls can be locked in either of two selected positions, one above the spars and one below the spars.

5. A boat in accordance with claim 1 having three hulls including a center hull affixed to said center structure and having the said pair of outrigger hulls mounted for rotation on said center structure wherein said outrigger hulls have locking means for locking the hulls in either a first position or a second position 180° apart and having an A-frame mast attached to said center structure, said mast being capable of being rotated to first and second positions 180° apart from said center structure.

* * * * *